United States Patent [19]

Itou et al.

[11] Patent Number: 4,848,125

[45] Date of Patent: Jul. 18, 1989

[54] WHEEL RIM FORMING MACHINE

[75] Inventors: Susumu Itou, Kawasaki; Yusaku Shinozawa, Tokyo; Tsunoru Nakamura, Fukuoka, all of Japan

[73] Assignees: Topy Kogyo Kabushiki Kaisha, Tokyo; Watanabe Tekko Kabushiki Kaisha, Fukuoka, both of Japan

[21] Appl. No.: 109,198

[22] Filed: Oct. 16, 1987

[51] Int. Cl.[4] ..... B21D 15/04

[52] U.S. Cl. ..... 72/105; 72/455

[58] Field of Search ..... 72/102, 105, 106, 108, 72/455; 29/159.1

[56] References Cited

U.S. PATENT DOCUMENTS

| | | | |
|---|---|---|---|
| 672,516 | 4/1901 | Schinneller | 72/108 |
| 1,767,755 | 6/1930 | Grotnes | 72/106 |
| 2,154,004 | 4/1939 | LeJeune | 72/105 |
| 3,045,516 | 7/1962 | Ashton et al. | 72/106 |
| 3,433,045 | 3/1969 | Wilson | 72/239 |
| 3,631,704 | 1/1972 | Leonard | 72/102 |
| 3,738,140 | 6/1973 | Motz et al. | 72/108 |

*Primary Examiner*—P. W. Echols

*Attorney, Agent, or Firm*—Cushman, Darby & Cushman

[57] ABSTRACT

A wheel rim forming machine including a fixed frame having four vertically extending columns. Due to the frame structure, the forming force acting at the top and bottom rolls of the machine are borne evenly through tensile forces acting in the four columns. Thus, no bending deformation occurs in the columns. Further, because the columns are not exposed to bending forces, they can be formed with a relatively small cross-section and thus the frame structure is compact. Therefore, access to the guide rolls and their support structure is facilitated and high grade adjustment of the guide rolls is possible.

14 Claims, 6 Drawing Sheets

WHEEL RIM FORMING MACHINE

BACKGROUND OF THE INVENTION

1. Field of the Invention

The present invention relates to a wheel rim forming machine.

2. Description of the Related Art

On a conventional disk wheel manufacture line for manufacturing disk wheels for a vehicle, disk wheels are manufactured by the following series of steps. First, a long plate of predetermined width is cut to plates of a specified length and each cut plate is rolled by a coiler into a rolled plate. The circumferential ends of the rolled plate is butt welded together with a welding machine to form a cylindrical rim element. The cylindrical rim element is conveyed to a flaring machine where both axial end portions of the cylindrical rim element are flared. Then, the flared rim element is conveyed to a rim forming station provided with at least one rim forming machine where it is formed to produce a specified rim shape. The formed rim element is then conveyed to a shaping machine where it is shaped to define a final rim configuration. The shaped rim element is conveyed to a disk insertion station where a disk is inserted into the rim element. The rim element and the disk are then conveyed to a welding station where they are welded together to form a disk wheel. Finally, the disk wheel is painted.

The prior art wheel rim forming machine comprises a top roll and a bottom roll for squeezing the rim element wall therebetween and a pair of guide rolls for guiding the rim element during formation. The machine further comprises a frame including a fixed frame and a driven frame adapted to be driven vertically relative to the fixed frame. The fixed frame has a laterally extending "U"-shaped frame which has upper and lower horizontally extending legs and a vertically extending base portion which connects the two legs. The top roll and the pair of guide rolls are supported by the driven frame, whereas the bottom roll is supported by the fixed frame. More particularly, the top roll is supported by a top roll shaft inserted therethrough and supported, in turn, with bearing devices mounted at each end portion of the shaft and coupled to the vertically driven frame. The bottom roll and the support structure therefore are divided axially into two portions so that the bottom roll can be inserted through the rim element and supports the same from the inside.

Using this machine, the rim element is formed in the following way: When the rim element is conveyed to the forming position in the machine, the two portions of the bottom roll and the support structure therefore are moved to the interior of the rim element so as to support the rim element from the inside. Then, the top roll is driven downward toward the bottom roll and the rim element wall is squeezed between the top and bottom rolls. Then, the top roll is driven so as to rotate and the entire circumference of the rim element is formed to produce a specified rim shape. After forming, the top roll is raised, the two portions of the bottom roll and the support structure thereof are separated, and the formed rim element is ejected from the forming position to the next station. With this machine, when the shape or size of the rim element to be formed is changed, the top and bottom rolls and the pair of the guide rolls must also be changed so as to correspond to the desired shape, diameter, width and thickness of the rim element.

Furthermore, the rim forming machine described above has a number of shortcomings.

First, because the fixed frame is "U"-shaped with laterally extending legs, it tends to elastically deform, opening the "U" when the frame is exposed to an upwardly directed force from the top roll via the driven frame and a downwardly directed force from the bottom roll. Thus, the clearance between the top and bottom rolls can vary during rim element formation. This varies the diameter of the formed wheel rim which will undesirably increase the vertical vibration of an associated vehicle. In addition, the variation in clearance will vary the thickness of the rim and will decrease the strength of the wheel itself.

Second, because the fixed frame is a laterally extending U frame, the vertically extending portion of the U frame is designed to have a large cross section to increase its rigidity and hence decrease the likelihood of elastic deformation during rim formation. Accordingly, only a limited amount of space is left between the top roll and the vertically extending portion for providing one of the paired guide rolls and a supporting structure for the one guide roll which extends toward the vertically extending portion of the U frame. Therefore, access to and the adjustment of the one guide roll and the supporting structure are difficult when the guide roll is to be exchanged. Insufficient adjustment or low grade adjustment of the guide roll and the support structure thereof degrades the shape of the formed wheel rim in the width direction and this will cause a lateral vibration of the vehicle to which the wheel rim is mounted.

SUMMARY OF THE INVENTION

An object of the present invention is to provide a wheel rim forming machine which minimizes the elastic deformation of the fixed frame and facilitates access to and adjustment of the guide rolls and the support structure thereof, thereby enabling production of consistently high grade wheel rims.

The above object is achieved by a wheel rim forming machine in accordance with the present invention, which comprises: (a) a top roll and a bottom roll for forming a wheel rim by squeezing a wall of the wheel rim therebetween, (b) a pair of guide rolls for guiding the wheel rim at both sides of the squeezed portion thereof during formation, and (c) a frame comprising a fixed frame including four vertically extending columns and a driven frame adapted to be driven relative to the fixed frame, the top roll and the pair of guide rolls being supported by the driven frame and the bottom roll being supported by the fixed frame, the four vertically extending columns being arranged symmetrically with respect to a center of symmetry comprising a center of the top roll, and the pair of guide rolls being arranged symmetrically with respect to an axis of symmetry comprising a rotational axis of the top roll.

According to the above structure, the forming force is borne evenly by the four columns. Thus, there is no bending deformation in the fixed frame. More particularly, the only deformation of the four columns is tension deformation and, accordingly, the deformation is very small in comparison to the bending deformation of the prior art. As a result, the direction of the force acting on the wheel rim from the top roll is always directed vertically and, thus, stable formation is possible. Furthermore, the cross section of each of the four columns can be small and a relatively large space can be defined around the top roll. The relatively large space is opened to the outside through the spaces between adjacent columns. Accordingly, the provision of and access to the guide roll and the support mechanism for the same is easier. As a result, high grade adjustment of the guide roll is possible at the time it is exchanged and, as a result, high grade formation of the wheel rim is possible.

BRIEF DESCRIPTION OF THE DRAWINGS

These and other objects and advantages of the present invention will become more apparent and can be more readily appreciated from the following detailed description of the presently preferred exemplary embodiment of the invention taken in conjunction with the accompanying drawing, wherein.

DETAILED DESCRIPTION OF THE PREFERRED EMBODIMENT

Figure 1:
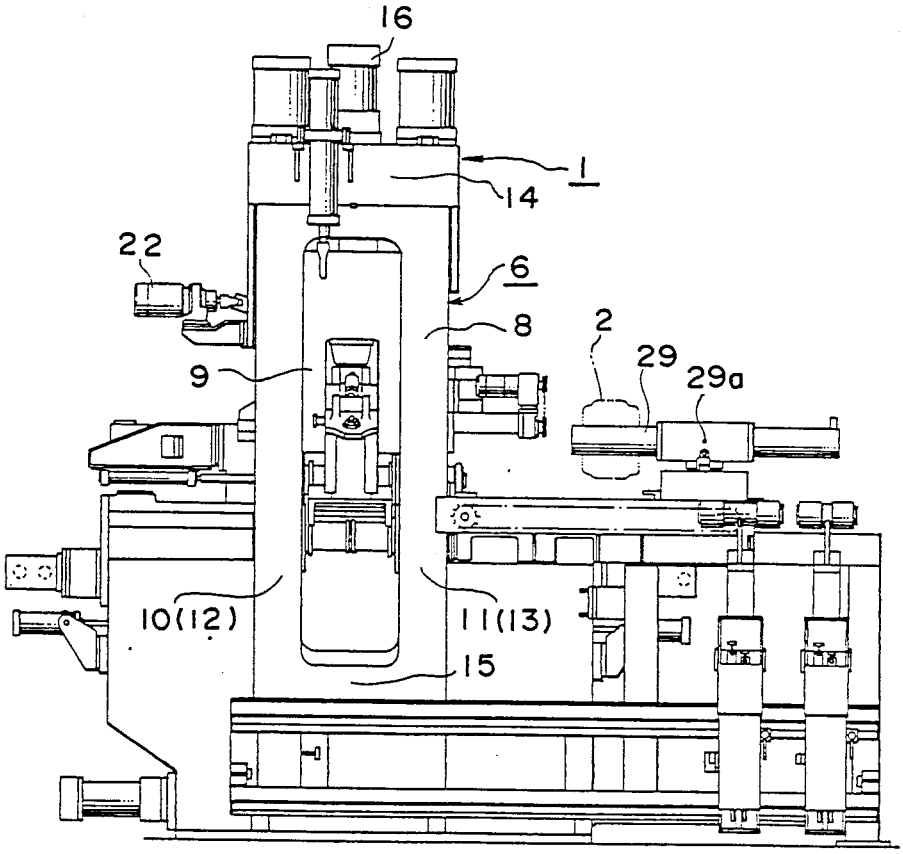
FIG. 1 is an elevational view of a wheel rim forming machine in accordance with one embodiment of the present invention.

As shown in FIGS. 1–4, a wheel rim forming machine 1 includes a top roll 2, a bottom roll 3, a pair of guide rolls 4 and 5, and a frame 6. Top roll 2 and bottom roll 3 form wheel rim 7 by squeezing the wall of wheel rim 7 therebetween. The pair of guide rolls 4 and 5 guide wheel rim 7 on either side of the squeezed portion during formation. Frame 6 comprises a fixed frame 8 which has four vertically extending columns 10, 11, 12 and 13 and a driven frame 9 which is adapted to be vertically driven relative to fixed frame 8. Top roll 2 and guide rolls 4 and 5 are supported by driven frame 9 and bottom roll 3 is supported by fixed frame 8. As shown in FIG. 5, the four vertically extending columns 10, 11, 12 and 13 are arranged symmetrically with respect to the center of top roll 2. More particularly, the four vertically extending columns 10, 11, 12 and 13 define a horizontally extending rectangle with the center of top roll 2 positioned at the symmetrical center of the rectangle. Guide rolls 4 and 5 are arranged symmetrically with respect to the rotational axis of top roll 2.

Figure 2:
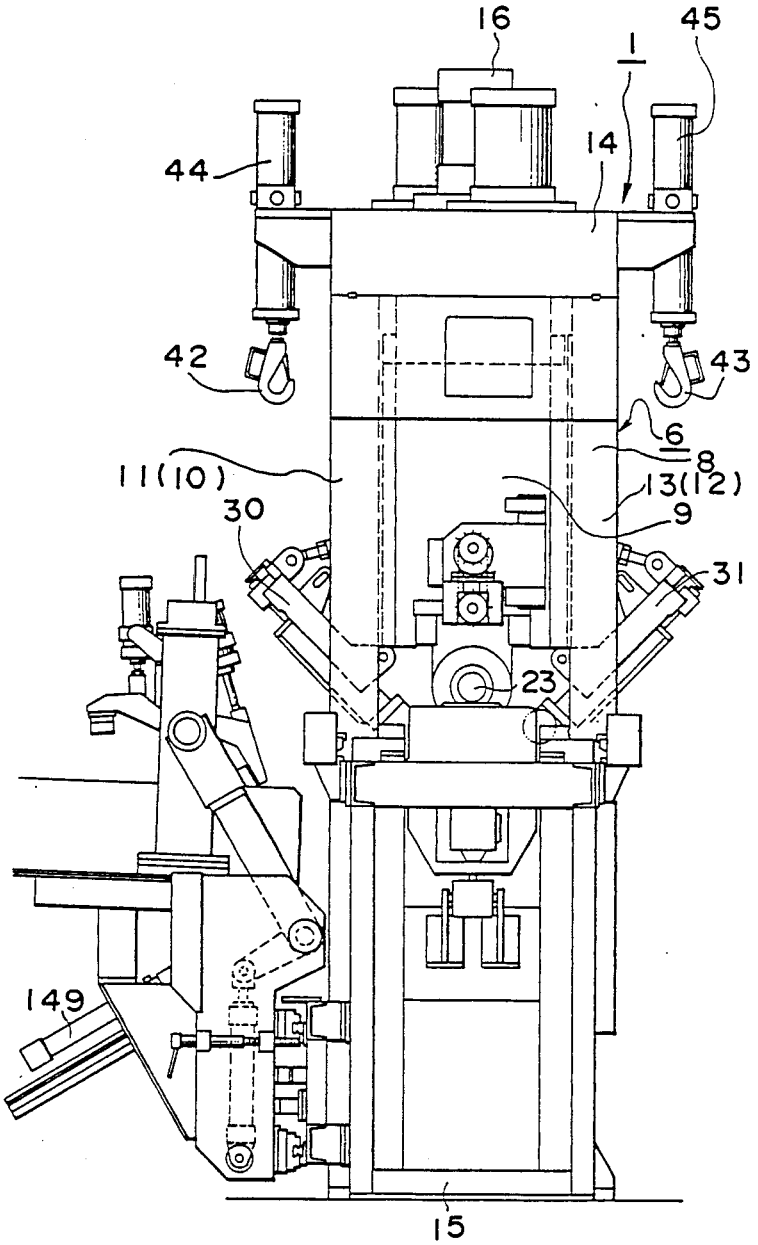
FIG. 2 is a side view of the machine shown in FIG. 1.

As shown in FIGS. 1 and 2, frame 8 further includes an upper frame 14 and a lower frame 15. Columns 10, 11, 12 and 13 are connected to upper frame 14 at upper portions thereof and are connected to lower frame 15 at lower portions thereof. Top roll 2 and bottom roll 3 are disposed within the space defined by columns 10, 11, 12 and 13 and upper and lower frames 14 and 15.

Figure 3:
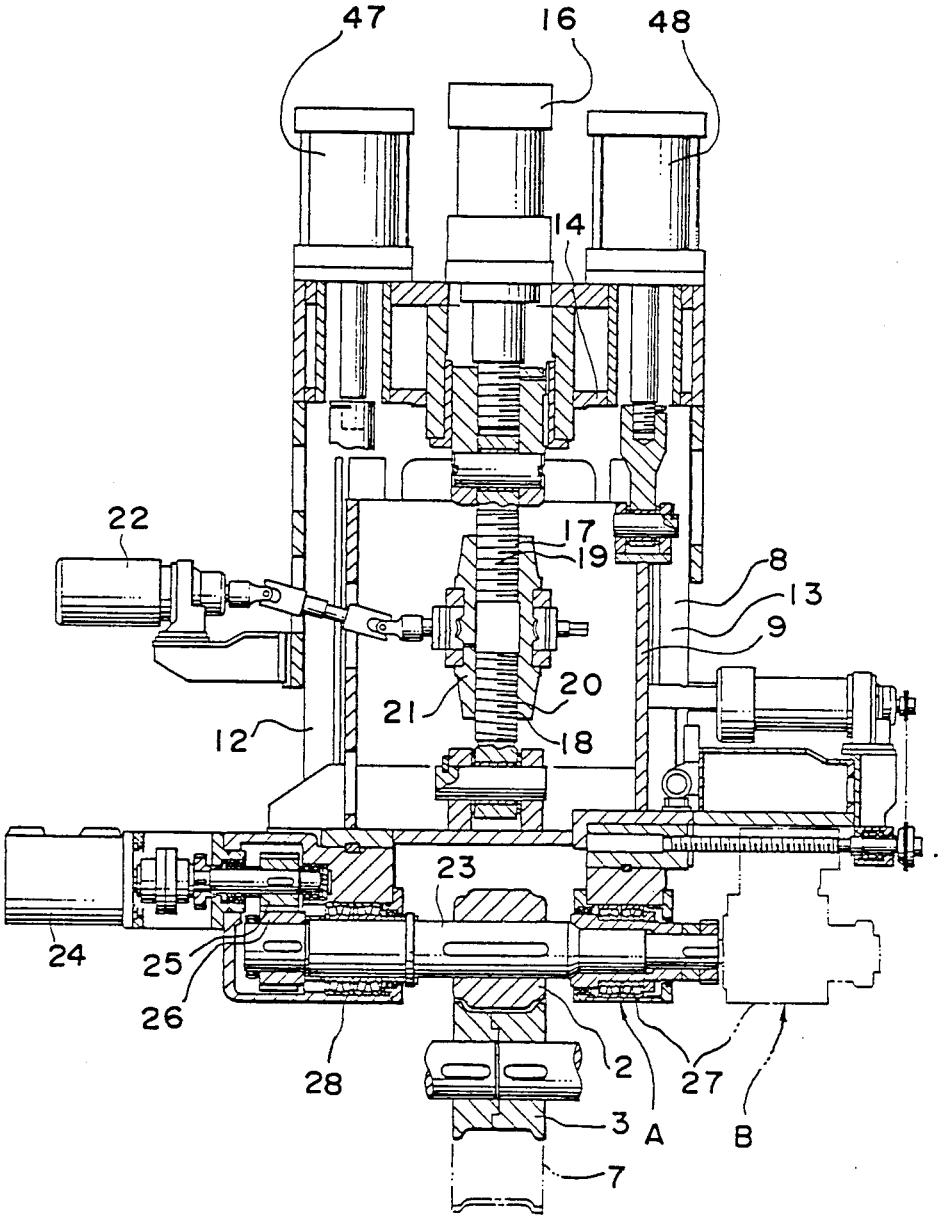
FIG. 3 is an enlarged elevational view, partially in cross-section, of a portion of the machine shown in FIG. 1.
Figure 4:
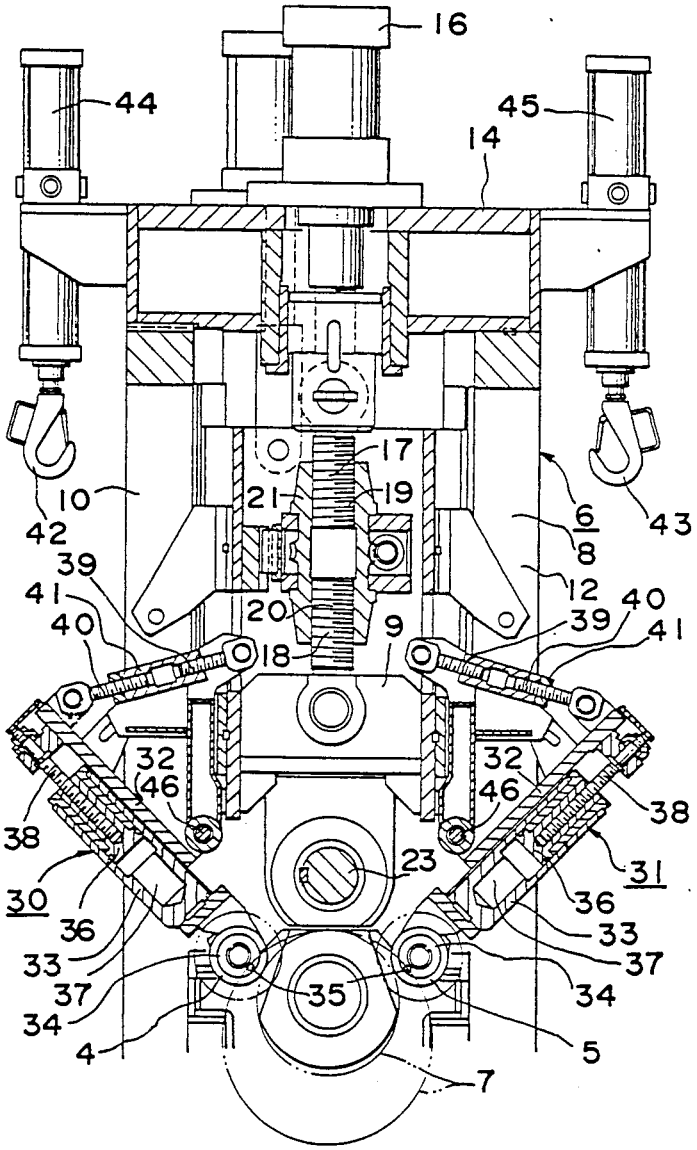
FIG. 4 is a side view of the machine shown in FIG. 3.
Figure 5:
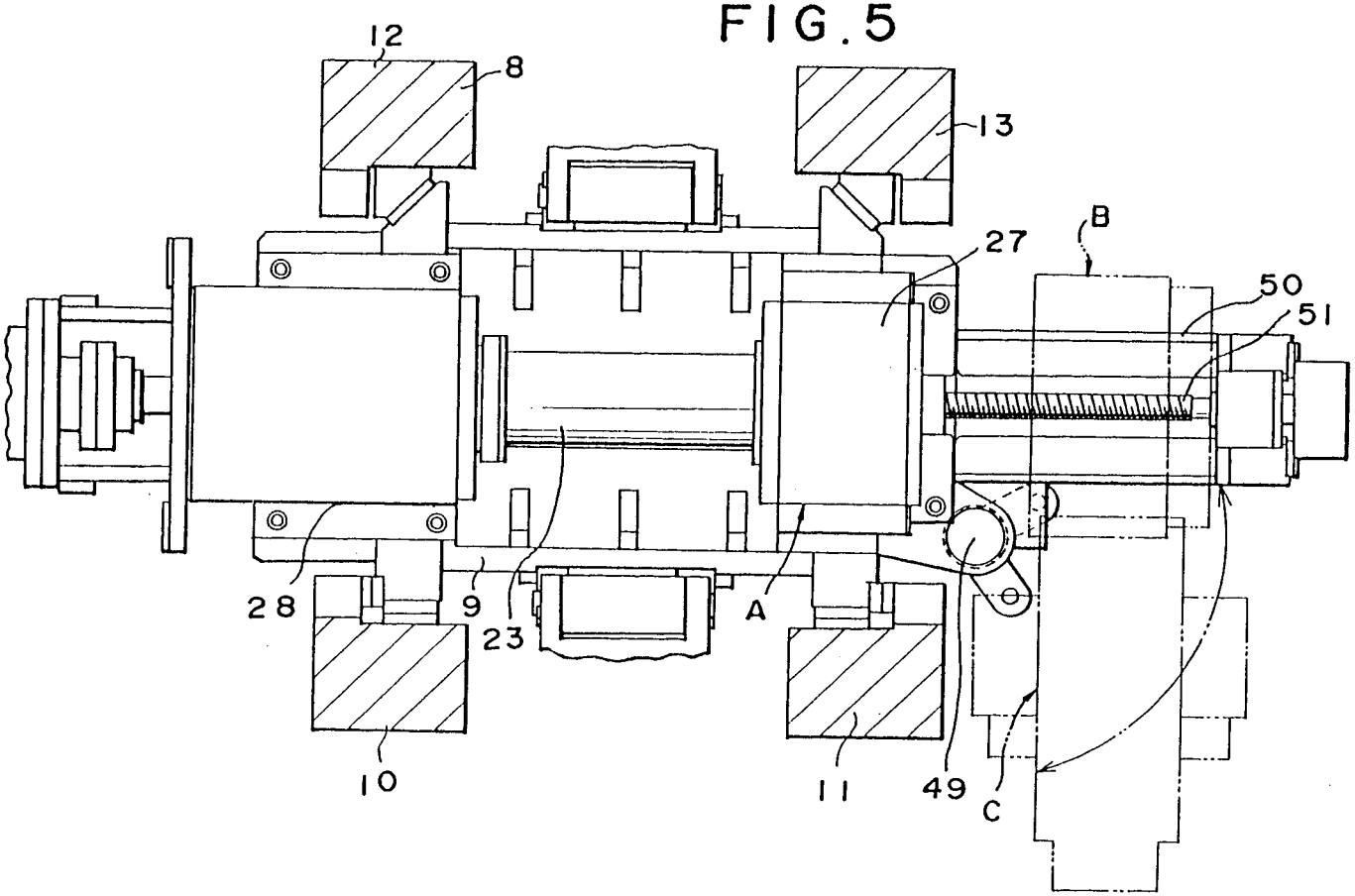
FIG. 5 is a plan view of the machine shown in FIG. 3.

As shown in FIGS. 3 and 4, at the top of wheel rim forming machine 1 a hydraulic cylinder 16 is provided which drives frame 9 together with top roll 2 vertically. The cylinder portion of hydraulic cylinder 16 is fixed to upper frame 14 and the rod portion is connected to driven frame 9.

As shown in FIGS. 3 and 4, between cylinder 16 and frame 9 a device for adjusting an initial vertical position of roll 2 is provided. The device comprises two vertically extending screw shafts 17 and 18 having oppositely threaded screw threads 19 and 20. One of screw shafts 17 and 18 is connected to cylinder 16 and the other is connected to frame 9. A screw coupling 21 threadingly engages threads 19 and 20 of shafts 17 and 18. Screw coupling 21 is in turn coupled to an electric motor 22 for rotating screw coupling 21. By operating electric motor 22, screw coupling 21 is rotated and thus the distance between shafts 17 and 18 can be varied. Accordingly, the initial position of top roll 2 can be adjusted.

Top roll 2 is supported by a top roll shaft 23 which is operatively coupled to a hydraulic motor 24 via gears 25 and 26. Hydraulic motor 24 is supported by frame 9 and rotates top roll 2 during formation of wheel rim 7.

Top roll shaft 23 engages roll 2 through a key so that top roll 2 rotates together with shaft 23 but can slide axially relative to shaft 23 when top roll 2 is changed. Shaft 23 is rotatably supported by a pair of bearing devices 27 and 28 which are supported by frame 9. As shown in FIG. 3 and FIG. 5, one of bearing devices 27 and 28 is movable axially between an engaging position A wherein it engages shaft 23 and a disengaged position B wherein it is disengaged from shaft 23 so that it can be disengaged from one end of shaft 23 at the time roll 2 is to be changed. The movable bearing device is driven by a screw shaft 51 which is supported by a movable frame 50 pivotally connected to driven frame 9. Thus, roll 2 can be removed from shaft 23 over the one free end. The movable bearing device can be moved horizontally about a pivot axis 49 between disengaged position B and a waiting position C wherein it is spaced from the extension of shaft 23. As shown in FIG. 1, a top roll loading-/unloading arm 29 which can be moved toward or away from top roll shaft 23 is provided in facing relation to the one end of shaft 23. Further, arm 29 is mounted so as to be rotatable about a vertical axis through a mid-portion **29*a* of the arm 29. Thus, when top roll 2 is exchanged, the movable bearing device (for example 27) is moved from its supporting position (an engaging position A) through its disengaged position to its waiting position. Arm 29 is then moved toward top roll shaft 23 to engage the free end thereof. Top roll 2 to be exchanged is slid from shaft 23 onto one free end portion of arm 29 and arm 29 is moved in the direction away from shaft 23. Arm 29 is rotated 180° and a substitute top roll which has been mounted on the other end portion of arm 29 is brought into facing relation to the free end portion of shaft 23. Then, arm 29 is moved toward shaft 23 so as to engage the free end portion of shaft 23 and the substitute top roll is slid from arm 29 to shaft 23. Arm 29 is then moved away from shaft 23**. Finally, the movable bearing device is returned to its supporting position.

Bottom roll 3 and the support structure thereof are substantially the same as those provided in the conventional machine discussed above. That is, as shown in FIG. 3, bottom roll 3 and the support structure thereof are axially divided into two portions so that bottom roll 3 can be inserted into and support from the inside.

Figure 6:
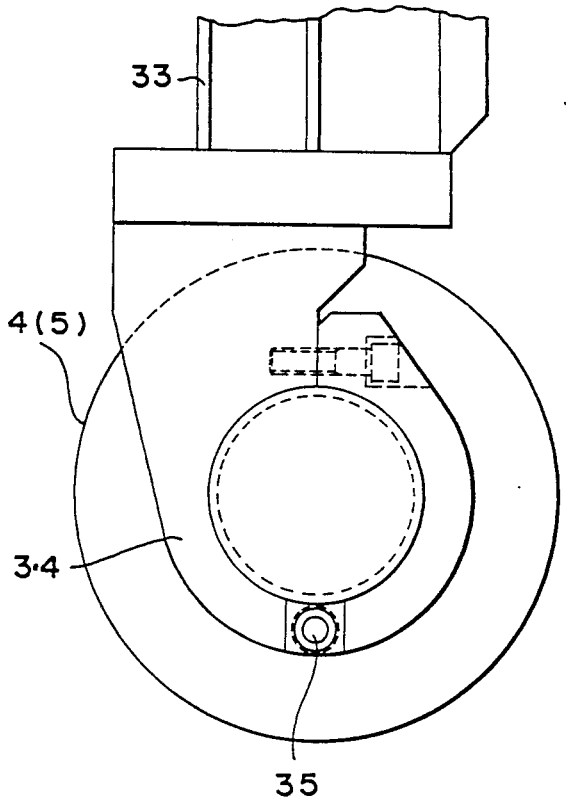
FIG. 6 is an enlarged side view of a guide roll support structure of the machine shown in FIG. 4.

As shown in FIG. 4, guide rolls 4 and 5 are supported by a pair of guide roll supporting devices 30 and 31, respectively. Each guide roll supporting device comprises a slide guide 32 pivotally connected to frame 9 at a pivot coupling 46, a slider 33 which is slidably supported by slide guide 32, and a guide roll bearing 34 supported by slider 33. Each guide roll bearing 34 rotatably supports a respective guide roll. Further, as shown in FIG. 6, guide roll bearing 34 has a hinge 35 to open or close the same so that direct mounting or removal of each guide roll is possible.

As shown in FIG. 4, a position adjustment device for adjusting the position of each guide roll 4 and 5 in a substantially radial direction of wheel rim 7 is mounted on each guide roll supporting device 30 and 31. The position adjustment device comprises a block 36 and a screw shaft 38. Block 36 is movable with respect to slide guide 32 in the longitudinal direction thereof and engages slider 33 such that the position of slider 33 in the direction toward wheel rim 7 is determined by block 36 shaft 38 is provided so as to operatively couple slide guide 32 and block 36 and threadingly engages block 36 such that when screw shaft 38 is rotated, block 36 is moved longitudinally relative to slide guide 32 and the position of each guide roll 4, 5 is adjusted via slider 33 in the substantially radial direction of wheel rim 7. Energizing means for pushing each guide roll 4 and 5 is also mounted on each guide roll supporting device 30 and 31. The energizing means comprises a spring or a hydraulic cylinder device. The spring or a liquid of the cylinder device is provided in the space 37 which is defined by block 36 and slider 33. The pushing force acting on the outside surface of wheel rim 7 from guide rolls 4 and 5 is determined by the position of block 36 and the spring force or compressed air pressure of the energizing means.

A guide roll energizing direction control device is provided on each guide roll supporting device 30 and 31 and comprises a pair of screw shafts 39 and 40 having oppositely threaded screw threads. One of screw shafts 39 and 40 is pivotally connected to frame 9 and the other of screw shafts 39 and 40 is pivotally connected to slide guide 32. A screw coupling 41 threadingly engages screw shafts 39 and 40. When screw coupling 41 is rotated, for example manually, the spacing between shafts 39 and 40 is varied and the inclination of guide roll supporting device 30 or 31 is adjusted.

As shown in FIG. 4, guide roll supporting devices 30 and 31 extend obliquely and vertically such that lower portions thereof are positioned inside the rectangle defined by columns 10, 11, 12 and 13 and upper portions thereof are positioned outside the rectangle.

As shown in FIG. 4, a pair of hooks 42 and 43 are provided above guide roll supporting devices 30 and 31, respectively. Hooks 42 and 43 are driven vertically by cylinders 44 and 45, respectively, and guide roll supporting devices 30 and 31 are suspended by hooks 42 and 43 when guide rolls 4 and 5 are exchanged.

Cylinders 47 and 48 shown in FIG. 3 are balance cylinders for balancing the weight of frame 9. A cylinder 149 shown in FIG. 2 is an air cylinder for pushing wheel rim 7 conveyed to rim forming machine 1 to the forming position within the machine.

Using the above apparatus, a wheel rim is formed as follows:

Wheel rim 7 is conveyed to the forming position within wheel rim forming machine 1. Two portions of bottom roll 3 and the support structure thereof which were previously axially spaced from each other are moved toward each other and inserted into wheel rim 7. Thus, wheel rim 7 is supported by bottom roll 3 from the inside. Then, top roll 2 and the pair of guide rolls 4 and 5 are lowered together with frame 9 by operating hydraulic cylinder 16. The wall of wheel rim 7 is press squeezed between top and bottom rolls 2 and 3. At the same time, guide rolls 4 and 5 are pushed against the outside surface of wheel rim 7 on either side of the squeezed portion. Pushing forces of guide rolls 4 and 5 are directed substantially toward the center of wheel rim 7. Then, top roll 2 is forcibly rotated together with top roll shaft 23 by operating hydraulic motor 24 so as to form wheel rim 7 over the entire circumference thereof. Guide rolls 4 and 5 prevent wheel rim 7 from,, being displaced axially and radially from the forming position of wheel rim 7. When wheel rim 7 has been formed, top roll 2 is raised by hydraulic cylinder 16, and the halves of bottom roll 3 and the support structure thereof are separated. The formed wheel rim 7 is ejected from the forming position and a successive wheel rim 7 is conveyed into the forming position.

Since fixed frame 8 comprises a frame having four columns 10, 11, 12 and 13, and since the formation force acting point defined between top and bottom rolls 2 and 3 is at the center of symmetry of the arrangement of the four columns 10, 11, 12 and 13, the formation force acting vertically is borne evenly by columns 10, 11, 12 and 13. Further, the force acting on columns 10, 11, 12 and 13 is a tensile force and no bending force acts on columns 10, 11, 12 and 13. Tensile deformation is very small compared to bending deformation and thus the deformation of fixed frame 8, if any, is very small. Accordingly, the formation force is kept substantially constant during formation. Further, the direction of the forming force is not inclined, that is, the direction of the force is always kept vertical. This decreases the likelihood that the shape of the formed wheel rim will deviate from a true circle and that the thickness of the formed wheel rim will deviate from a specified thickness. In a test of the machine as compared to the known machine, diameter deviation was decreased from 0.6 mm with the prior art to less than 0.3 mm with the present invention and thickness reduction was decreased from 22% with the prior art to less than 12% with the present invention.

Next, the exchange and adjustment of the pair of guide rolls 4 and 5 and effects obtained will be explained.

When the type of wheel rim 7 to be conducted through the manufacture line is changed, guide rolls 4 and 5 are exchanged. First, hooks 42 and 43 are lowered by operating cylinders 44 and 45 and hooks 42 and 43 are engaged with guide roll supporting devices 30 and 31. Coupling 46 is relieved and guide roll supporting devices 30 and 31 are supported by hooks 42 and 43. Hooks 42 and 43 are then raised by operating cylinders 44 and 45 and guide roll supporting devices 30 and 31 are suspended by hooks 42 and 43. By this suspension, guide rolls 4 and 5 and guide roll bearings 34 thereof are disposed outside the rectangle defined by columns 10, 11, 12 and 13 and, accordingly, access to guide rolls 4 and 5 and guide roll bearings 34 is easy. Then, each guide roll bearing 34 is opened at hinge 35 and guide rolls 4 and 5 are replaced with new guide rolls. Then, each guide roll bearing 34 is closed at hinge 35, hooks 42 and 43 are lowered, and guide roll supporting devices 30 and 31 are again pivotally connected to frame 9 by coupling 46.

Adjustment of the positions of guide rolls 4 and 5 is performed by rotating screw shaft 38 and adjusting the position of block 36. Adjustment in direction of the pushing forces of guide rolls 4 and 5 is accomplished by rotating screw coupling 41 so as to rotate guide roll supporting devices 30 and 31. Because there is no bending moment in the structure of frame 8, columns 10, 11, 12 and 13 can be formed with relatively small cross-sections and since one portion of screw shaft 38 and one portion of screw coupling 41 protrude outside the rectangle defined by columns 10, 11, 12 and 13, access to the same is very easy. As a result, high grade adjustment of guide rolls 4 and 5 and the support structure thereof is possible. High grade adjustment of the guide rolls minimizes the deviations from a specified shape and width and, therefore, lateral vibration of an associated vehicle is decreased. In a test comparing this invention to the prior art device, lateral deviation was decreased from 0.6 mm with the prior art to 0.3 mm−0.1 mm or less with the present invention. Further, due to the easy access of the present invention, working time for exchanging guide rolls 4 and 5 was decreased from 20 minutes with the prior art to 5 minutes with the present invention.

Although only one embodiment of the present invention has been described in detail, it will be appreciated by those skilled in the art that various modifications and alterations can be made to the particular embodiment shown without materially departing from the novel teachings and advantages of the present invention. Accordingly, it is to be understood that all such modifications and alterations are included within the spirit and scope of the present invention as defined by the following claims.

What is claimed is:

1. A wheel rim forming machine comprising:

a top roll and a bottom roll for forming a wheel rim by squeezing a wall of said wheel rim therebetween;

means operatively coupled to said top roll, for rotatably driving said top roll, said top roll driving means including a horizontally extending top roll shaft for mounting said top roll and a pair of bearing devices for rotatably supporting said top roll shaft, one of said bearing devices comprising a removable bearing device for enabling exchange of said top roll;

a pair of guide rolls for engaging said wheel rim on either circumferential side, respectively, of the squeezed portion of said wheel rim to guide said wheel rim during formation;

a pair of guide roll supporting devices coupled to said guide rolls; and a frame comprising a fixed frame including four vertically extending columns and a driven frame adapted to be driven relative to said fixed frame, said top roll and said pair of guide rolls being supported by said driven frame and said bottom roll being supported by said fixed frame, said four vertically extending columns being arranged substantially symmetrically with respect to a vertical axis of said wheel rim forming machine passing through a center of said top roll and said pair of guide rolls being arranged substantially symmetrically with respect to a vertical plane including a rotational axis of said top roll, said four vertically extending columns being spaced from each other over substantially their entire lengths thereof so as to provide, between adjacent columns, spaces through which said top roll driving means and said guide roll supporting devices extend, said removable bearing device is moved while said top roll is exchanged, and a wheel rim is supplied and removed to and from a forming position located in an imaginary rectangle defined by said four vertically extending columns.

2. The wheel rim forming machine according to claim 1, wherein said fixed frame further includes an upper frame and a lower frame, said four vertically extending columns being connected to said upper frame at upper portions thereof and being connected to said lower frame at lower portions thereof.

3. The wheel rim forming machine according to claim 2, further comprising a hydraulic cylinder operatively coupled to said driven frame for driving said driven frame in a vertical direction, a cylinder portion of said hydraulic cylinder being coupled to said upper frame and a rod portion of said hydraulic cylinder being connected to said driven frame.

4. The wheel rim forming machine according to claim 3, further comprising:

two vertically extending screw shafts having oppositely threaded screw threads, one of said screw shafts being coupled to said hydraulic cylinder and the other of said screw shafts being coupled to said driven frame;

a screw coupling member threadingly engaged with said screw threads of each of said screw shafts; and an electric motor means, operatively coupled to said screw coupling, for rotating said screw coupling, whereby an initial vertical position of said top roll is adjustable by operating said electric motor.

5. The wheel rim forming machine according to claim 1, wherein said top roll driving means comprises a motor means, operatively coupled to said top roll, for rotatably driving said top roll, said motor means being supported by said driven frame.

6. The wheel rim forming machine according to claim 5, wherein said motor means comprises a hydraulic motor.

7. The wheel rim forming machine according to claim 1, wherein:

said top roll is coupled to said top roll shaft with a key-type coupling such that said top roll can rotate together with said top roll shaft during formation of said wheel rim and can slide in an axial direction of said top roll shaft relative to said top roll shaft when said top roll is to be removed therefrom; and said bearing devices are coupled to said driven frame, one of said pair of bearing devices being movable axially relative to said top roll shaft so that said one bearing device can disengage from said top roll shaft when said top roll is to be removed.

8. The wheel rim,.forming machine according to claim 1, wherein each of said guide roll supporting devices comprises a slide guide pivotally connected to said driven frame, a slider which is slidably supported by said slide guide, and a guide roll bearing, supported by said slider, for rotatably supporting each of said guide rolls 9. The wheel rim forming machine according to claim 8, wherein said guide roll bearing includes means for opening and closing so as to enable direct mounting and removal of each of said guide rolls.

10. The wheel rim forming machine according to claim 8, further comprising a guide roll position adjustment device which comprises a block element mounted on said guide roll supporting device so as to be axially adjustable relative to said slide guide and a screw shaft which is provided between said block element and said slide guide.

11. The wheel rim forming machine according to claim 10, further comprising a guide roll energizing means comprising a spring said spring being housed in a space defined by said block element and said slide.

12. The wheel rim forming machine according to claim 8, further comprising a guide roll energizing direction control device which comprises a pair of screw shafts having oppositely threaded screw threads, one of which is pivotally connected to said driven frame and the other of which is pivotally connected to said slide guide, and a screw coupling threadingly engaging said pair of screw shafts.

13. The wheel rim forming machine according to claim 8, further comprising a hook element provided vertically above said guide roll supporting device and a cylinder, coupled to said fixed frame, for vertically driving said hook element.

14. The wheel rim forming machine according to claim 8, wherein each of said guide roll supporting devices extends obliquely such that a lower portion thereof is positioned inside the imaginary rectangle defined by said four columns and an upper portion thereof is positioned outside said rectangle.

* * * * *